US005896615A

United States Patent [19]

Zaksenberg

[11] Patent Number: 5,896,615

[45] Date of Patent: Apr. 27, 1999

[54] INTERDENTAL BRUSH

[75] Inventor: Issac Zaksenberg, Scotch Plains, N.J.

[73] Assignee: Colgate-Palmolive Company, New York, N.Y.

[21] Appl. No.: 08/847,899

[22] Filed: Apr. 28, 1997

[51] Int. Cl.[6] ..... A46B 9/04; A46B 5/02

[52] U.S. Cl. ..... 15/167.1; 15/172; 15/176.1; 15/176.5; 15/143.1

[58] Field of Search ..... 15/143.1, 172, 15/176.1, 176.3, 176.4, 176.5, 176.6, 167.1

[56] References Cited

U.S. PATENT DOCUMENTS

| | | | |
|---|---|---|---|
| 154,683 | 11/1874 | Wickberg . | |
| D. 238,834 | 2/1976 | Hjelle . | |
| D. 293,858 | 1/1988 | Tarrson . | |
| D. 321,286 | 11/1991 | Aldrich . | |
| D. 334,474 | 4/1993 | Sauceda . | |
| D. 335,579 | 5/1993 | Chuang . | |
| D. 363,820 | 11/1995 | Winge . | |
| D. 365,209 | 12/1995 | Plummer . | |
| D. 370,782 | 6/1996 | Millner . | |
| 490,831 | 1/1893 | Lohers . | |
| 958,371 | 5/1910 | Danek . | |
| 1,131,863 | 3/1915 | Phillips . | |
| 1,706,053 | 3/1929 | Bussinger | 15/176.1 |
| 1,750,500 | 3/1930 | Weisz | 15/176.4 |
| 1,809,330 | 6/1931 | Dorrance . | |
| 1,859,129 | 5/1932 | Costenbader | 15/172 |
| 1,944,797 | 1/1934 | McElwain | 15/176.4 |
| 2,094,240 | 9/1937 | Herrick . | |
| 2,164,219 | 6/1939 | McGerry . | |
| 2,679,657 | 6/1954 | Krueger . | |
| 3,559,226 | 2/1971 | Burns . | |
| 3,939,520 | 2/1976 | Axelsson . | |
| 4,222,143 | 9/1980 | Tarrson . | |
| 4,274,174 | 6/1981 | Ertel . | |
| 4,319,377 | 3/1982 | Tarrson . | |
| 4,387,479 | 6/1983 | Kigyos . | |
| 4,592,109 | 6/1986 | Borea . | |
| 4,598,437 | 7/1986 | Ernest . | |
| 4,691,404 | 9/1987 | Tarrson . | |
| 4,710,996 | 12/1987 | Tarrson . | |
| 4,780,923 | 11/1988 | Schultheiss . | |
| 4,809,389 | 3/1989 | Breitschmid . | |
| 4,828,420 | 5/1989 | Otsuka . | |
| 5,029,358 | 7/1991 | Zimmerman . | |
| 5,058,230 | 10/1991 | Hodosh . | |
| 5,201,091 | 4/1993 | Tarrson . | |
| 5,283,924 | 2/1994 | Kaminski . | |
| 5,313,684 | 5/1994 | Fitjer . | |
| 5,377,377 | 1/1995 | Bredall . | |
| 5,435,033 | 7/1995 | Millner . | |
| 5,497,526 | 3/1996 | Klinkhammer . | |
| 5,555,590 | 9/1996 | Blum | 15/176.5 |

FOREIGN PATENT DOCUMENTS

| | | | |
|---|---|---|---|
| 0 537 663 | 4/1993 | European Pat. Off. . | |
| 472405 | 12/1914 | France . | |
| 552210 | 11/1925 | France . | |
| 0617605 | 2/1927 | France | 15/176.4 |
| 802463 | 9/1936 | France . | |
| 8303829 | 11/1983 | Netherlands . | |
| 672723 | 12/1989 | Switzerland . | |
| 293289 | 7/1928 | United Kingdom . | |
| 2044089 | 10/1980 | United Kingdom . | |
| 2081570 | 2/1982 | United Kingdom . | |
| 2109288 | 6/1983 | United Kingdom . | |

*Primary Examiner*—Randall E. Chin
*Attorney, Agent, or Firm*—Michael McGreal

[57] ABSTRACT

The interdental brush has a quadrangular shaped handle portion with an angled brush head portion with a brush head cartridge attached at one end and a removable brush head holder at the other end. The brush head can fit in a contra-angle arrangement or co-directional arrangement to the angle of the handle and the brush head support. In addition, there is a positive grip handle with a projecting thumb finger grip. The removable brush head holder into which the brush head can fit provides a smaller interdental brush and one that can be used away from home.

20 Claims, 4 Drawing Sheets

INTERDENTAL BRUSH

FIELD OF THE INVENTION

This invention relates to an interdental brush that has an angled handle and plural positioned brush head. Further, this invention relates to an interdental brush which has as an integral part, a shortened holder for a brush head.

BACKGROUND OF THE INVENTION

Interdental brushes are used as a part of the teeth cleaning regimen of many people. They are useful brushes to clean between teeth, near the gum line, around various dental prosthesis, such as braces, and around various bridge work. Interdental brushes have a shape that can penetrate many spaces that a regular toothbrush cannot penetrate. Also, there are several brush head shapes that can be used. This improves the level of a person's oral care hygiene.

A problem with interdental brushes is the lack of versatility of the units. Many are straight, stick-like holders. Others that have a contra-angle are useful with the brush head in only one direction. Also, most do not have fully formed insert cartridges. They rely on the user to bend the wire of the brush head and attach it to a handle. And none of these interdental brush units combine an at home brush and a portable brush consisting of a detachable sub-unit that can be used for travel and other away-from-home use. All of these problems are solved and needs met with the interdental brush of this invention.

BRIEF SUMMARY OF THE INVENTION

The present interdental brush is easily gripped and held and has an angled handle coupled with a brush head cartridge which can be used extending opposite to the angle of the handle, i.e. contra-angle, or co-directional with the angle of the handle. The complementary shape of the brush head cartridge attachment and the handle attachment permits the brush head to be co-directional with the handle angle or opposite to the handle angle. This provides for more versatility in the use of the brush to reach the various spaces in a person's mouth.

In addition, the interdental brush handle incorporates at an end opposite the brush head a segment that can be removed and onto which a brush head cartridge can be mounted. This provides for a smaller away-from-home option to be built into the interdental brush. A person can take the smaller handle segment and a cartridge along for use during a day.

More particularly, the interdental brush is comprised of a substantially straight handle portion and an angled brush head support portion. The angled portion is at an angle A of about 145° to about 175°, and preferably about 160° to about 170° to the straight handle portion. At the end of the angled brush head support portion there is an attachment means for a brush head cartridge, the brush head cartridge being a unit having a shaped portion adapted to fit into the angled brush head support portion on one end and a brush head at the other end. The brush head cartridge can fit into the angled brush head support portion co-directional or contra-directional to the angle of the handle. At the end of the handle portion remote from the angled brush head support portion, there is the removable portion into which an interdental brush head cartridge can be inserted. This can be used as an away-from-home interdental brush.

The handle has a generally quadrangular, cross-sectional shape in the area of the angled portion to an essentially circular cross-section at the removable portion of the handle.

There also is a thumb finger grip projection which extends above the plane of the handle. This provides for an improved gripping of the interdental brush.

DETAILED DESCRIPTION OF THE DRAWINGS

The present interdental brush will be described with reference to the drawings.

Figure 1:
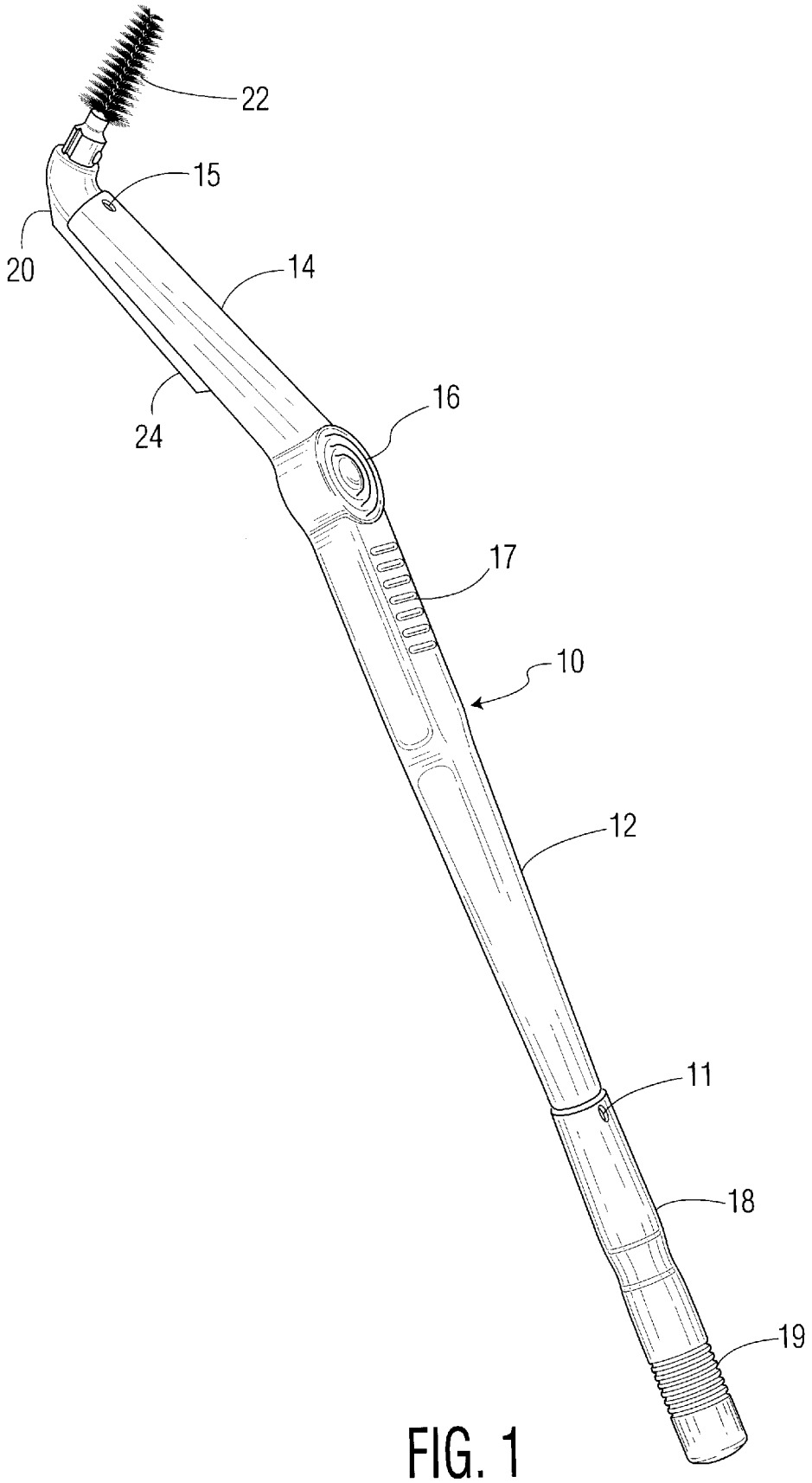
FIG. 1 is a perspective view of the interdental brush showing the brush head in a contra-angle orientation to the angle of the angled brush head support.

In FIG. 1 there is shown interdental brush 10 which has handle grip portion 12 with an angled brush head support portion 14 at one end. Grip features 16 and 17 facilitate the gripping of the interdental brush. Grip features 16 is raised above the plane of the handle to provide a firm thumb grip area. Grip feature 17 on the opposite side of the handle will be contacted by the side of one or more fingers. Extending from the brush head support portion is brush head cartridge 20 which carries brush 22. First longitudinal rod section 24 is a part of the brush head attachment means. Aperture 15 on the brush head portion accepts a protrusion on the brush head cartridge to lock the brush head cartridge into the angled brush head support portion. At the end of the handle grip portion 12 opposite the brush head portion, there is a removable section 18 which carries a grip 19. This is held in place by a protrusion 34 on the brush head support rod 30 (see FIG. 2) which extends into aperture 11 of the removable section. This view shows the brush 22 in a contra-angle orientation. It extends opposite to the handle angle.

The cross-section of the elongated handle in the area of grips 17 on the opposite side of the handle is essentially quadrangular. This shape along with grips 16 and 17 aid in gripping the interdental brush. The raised thumb grip provides for a secure gripping of the interdental brush handle.

Figure 2:
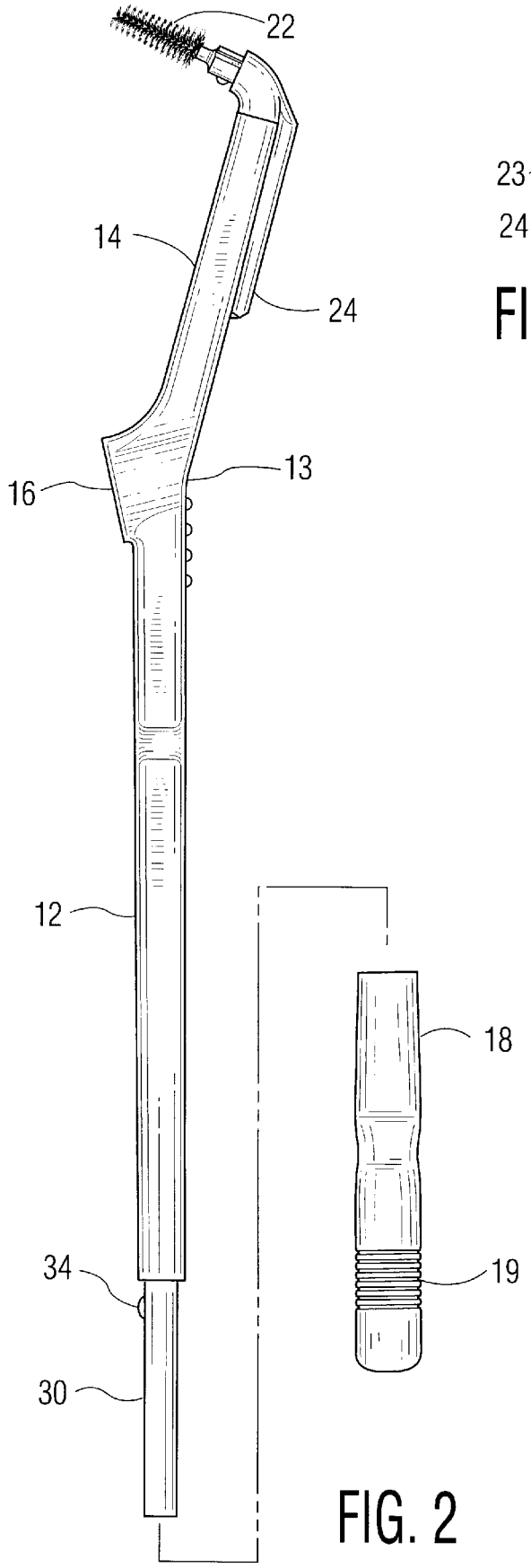
FIG. 2 is a side elevational view of the interdental brush with the end handle portion removed.

FIG. 2 shows the interdental brush in elevation and with the removable piece 18 removed. In this view, protrusion 34 is seen. This protrusion fits into aperture 11 to hold the removable section 18 onto the interdental brush. This view also shows the brush 22 in a contra-angle orientation as in FIG. 1.

Figure 3:
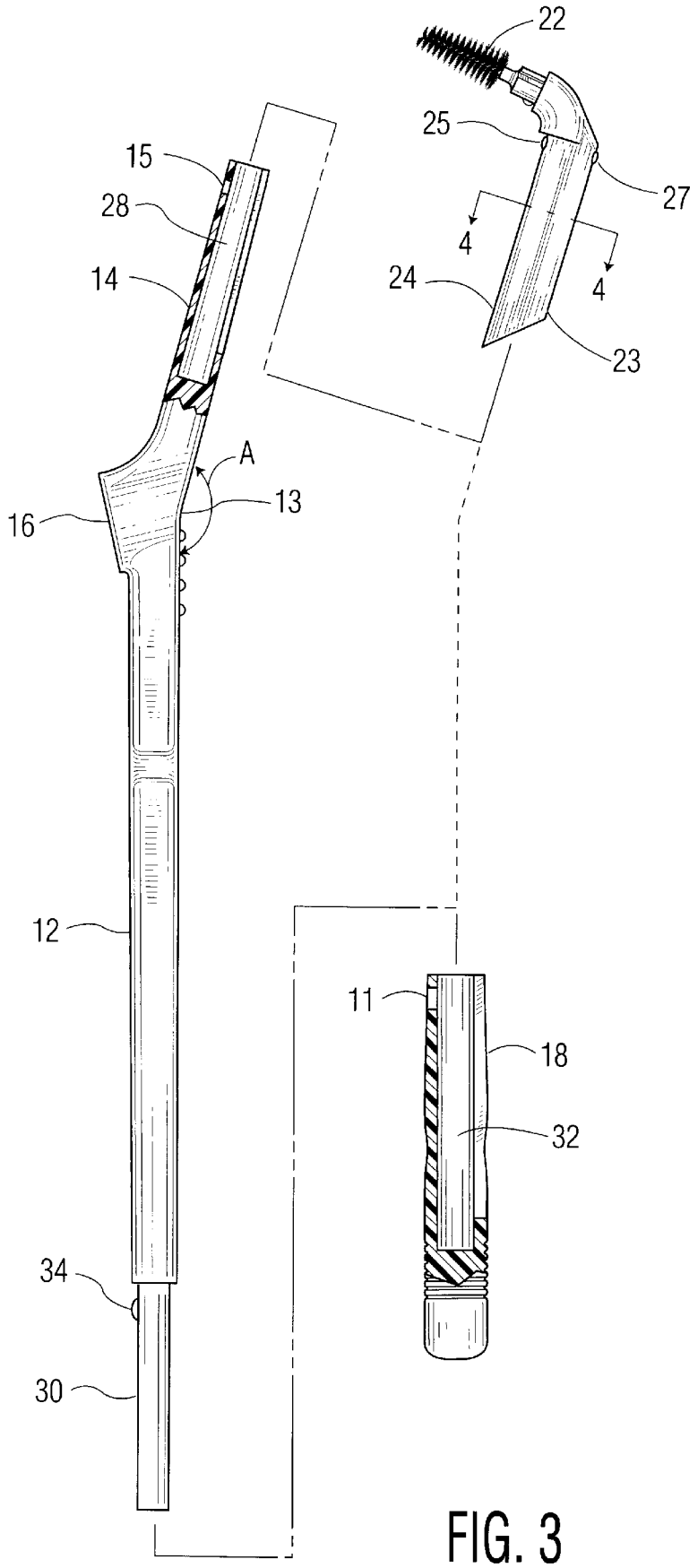
FIG. 3 is a side elevational view of the interdental brush partially in section showing the brush head in an orientation as shown in FIG. 1.

FIG. 3 shows in a cutaway view the attachment of the removable portion and brush head cartridge onto the interdental brush. The angled brush head support portion has a channel 28 into which rod portion 23 or 24 can be fitted. As shown, rod 22 is within channel 28. The brush head is inserted in accordance with the desired direction of the brush head. The brush head can fit co-directional with the angle 13 of the angled brush head support portion or contra with the angle 13 of the angled brush head support portion. This allows the brush head to extend in fully opposite directions. This provides for more effective cleaning between teeth and teeth and gums and prothesis. Protrusions 25 and 27 will fit into aperture 15 to maintain the brush head onto the interdental brush regardless of the orientation of the brush head.

At the other end, there is shown removable portion 18 which has a channel 32. When in place on the interdental brush handle, extension rod 30 fits into channel 32 with projection 34 fitting into aperture 11 to maintain the removable section onto handle extension 30.

Figure 4:
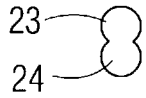
FIG. 4 is a cross-sectional view of the attachment portion of a brush head cartridge.

FIG. 4 is a cross-section of the attachment rods 22 and 24 of the brush head. Each of rod portion 23 and rod portion 24 is of a size to fit into channel 28. Protrusions 25 and 27 lock the brush head into channel 28 by extending into aperture 15.

Figure 5:
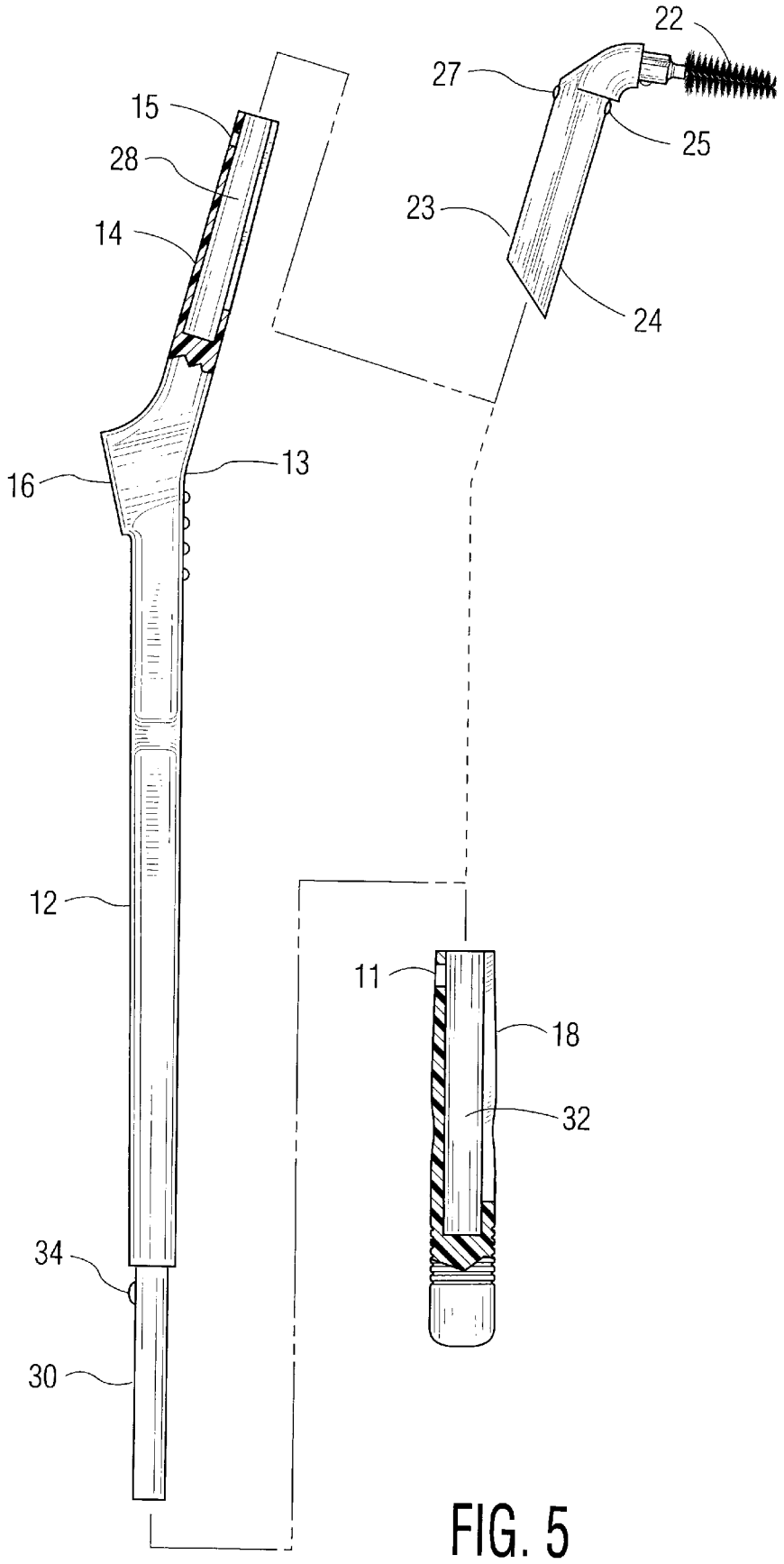
FIG. 5 is a side elevational view of the interdental brush showing the brush head co-directional angle orientation to that of the angled brush head support.

FIG. 5 shows the brush head cartridge extending in a direction that is co-directional with the angle between the handle and brush head support portion. This illustrates the versatility of this interdental brush. As shown rod 24 is within channel 28.

The angle A of the brush head support portion to the handle portion will be about 145° to about 175°, and preferably about 160° to 170° to the handle portion. The handle portion is primarily straight and planar. This facilitates holding the interdental brush in ones hand. The brush head support portion preferably is straight and planar, however, this is not a requirement.

The angle of the brush 22 with respect to the remainder of the cartridge is about 60 degrees to about 120 degrees, and usually about 90 degrees.

The interdental brush can be effectively made from essentially any moldable plastic. These include polyesters, polyolefins, and polystyrenes and olefin-styrene copolymers. As noted, other resins can be used.

In use, a brush head is inserted into the brush head support portion in a contra-angle or co-directional orientation. It is locked in place and used in an oral care regimen. During use the orientation of the brush head can be changed from contra-angle to co-directional, and vice versa, as needed. This multiangular use makes this interdental brush more versatile. It is easier in the different orientation to insert into the spaces in the month.

Also, the removable holder 18 can be removed and taken along in a pocket or purse with a brush head. This then can be used during the day.

Various modifications can be made to this interdental brush and be within the disclosed concepts. All such modifications are considered to be within the present invention.

What is claimed is:

1. An interdental brush comprising an elongated handle portion having an angled brush head support portion at one end to support a brush head cartridge and a removable portion at another end, the angled brush head support portion extending from said elongated handle portion terminating in a means for attaching said brush head cartridge, said brush head cartridge and said means for attaching said brush head cartridge cooperating for the attachment of said brush head cartridge in a direction that is one of co-directional and contra-directional to the angle of said handle portion and said angled brush head support portion.

2. An interdental brush as in claim 1 wherein said means for attaching attaches said brush head in said co-directional orientation.

3. An interdental brush as in claim 1 wherein said means for attaching attaches said brush head in said contra-directional orientation.

4. An interdental brush as in claim 1 wherein said cooperating attachment means on said angled brush head support portion comprises a channel.

5. An interdental brush as in claim 4 wherein said cooperating attachment means on said brush head cartridge comprises a rod.

6. An interdental brush as in claim 1 wherein said brush head cartridge comprises an attachment means at one end and a brush head on an other end, said brush head being at an angle of about 60° to 120° to said attachment means.

7. An interdental brush as in claim 6 wherein said brush head is at an angle of about 90° to said attachment means.

8. An interdental brush as in claim 1 wherein said angled brush head support portion is at an angle of about 145° to about 175° to said elongated handle portion.

9. An interdental brush as in claim 8 wherein said angled portion is at an angle of about 160° to about 170° to said elongated handle portion.

10. An interdental brush as in claim 1 wherein said removable portion has an attachment means for attaching said removable portion to said elongated handle portion, said attachment means comprising a cooperating channel adapted to attach to an interfitting rod arrangement on said elongated handle portion.

11. An interdental brush as in claim 10 wherein said brush head cartridge attaches to the attachment means of said removable portion.

12. An interdental brush as in claim 1 wherein at the end of said elongated handle adjacent said angled portion, a cross-section of said elongated handle is quadrangular.

13. An interdental brush comprising an elongated handle portion having an angled brush head support portion at one end to support a brush head cartridge, the angled brush head support portion extending from said elongated handle portion and terminating in a means for attaching said brush head cartridge, said brush head cartridge and said means for attaching said brush head cartridge cooperating for the attachment of said brush head cartridge in a direction that is one of co-directional and contra-directional to the angle of said handle portion and said angled brush head support portion, said elongated handle portion having a grip structure at a junction of said elongated handle portion and said angled brush head support portion and being essentially quadrangular in the area of said grip structure, said grip structure comprising a raised thumb grip projection on one side thereof and a plurality of grip projections for at least one finger on an opposite side thereof.

14. An interdental brush as in claim 13 wherein said means for attaching attaches said brush head in said co-directional orientation.

15. An interdental brush as in claim 13 wherein said means for attaching attaches said brush head in said contra-directional orientation.

16. An interdental brush as in claim 13 wherein said cooperating attachment means on said angled brush head support portion comprises a channel.

17. An interdental brush as in claim 16 wherein said cooperating attachment means on said brush head cartridge comprises a rod.

18. An interdental brush as in claim 13 wherein said brush head cartridge comprises an attachment means for attaching said brush head cartridge to said brush head support portion at one end and a brush head on an other end, said brush head being at an angle of about 60° to 120° to said attachment means.

19. An interdental brush as in claim 13 wherein said angled brush head support portion is at an angle of about 145° to about 175° to said elongated handle portion.

20. An interdental brush as in claim 19 wherein said angled portion is at an angle of about 160° to about 170° to said elongated handle portion.

* * * * *